United States Patent [19]

Yuyama et al.

[11] Patent Number: 4,711,874

[45] Date of Patent: Dec. 8, 1987

[54] THERMOSENSITIVE RECORDING ADHESIVE SHEET

[75] Inventors: Yukihiro Yuyama; Takanori Motosugi; Yasuhiro Honda; Akira Ichikawa, all of Numazu, Japan

[73] Assignee: Ricoh Company, Ltd., Tokyo, Japan

[21] Appl. No.: 767,432

[22] Filed: Aug. 20, 1985

[30] Foreign Application Priority Data

Aug. 20, 1984 [JP] Japan ..... 59-126089[U]
Dec. 20, 1984 [JP] Japan ..... 59-193475[U]

[51] Int. Cl.[4] ..... B41M 5/18

[52] U.S. Cl. ..... 503/206; 427/152; 428/40; 428/203; 428/204; 428/913; 428/914; 503/226

[58] Field of Search ..... 346/200, 226; 427/150, 427/151, 152; 428/913, 914, 40, 203, 204; 503/206

[56] References Cited

U.S. PATENT DOCUMENTS

| | | | |
|---|---|---|---|
| 4,370,370 | 1/1983 | Iwata et al. | 346/226 |
| 4,401,721 | 8/1983 | Hida | 427/150 |
| 4,424,245 | 1/1984 | Maruta et al. | 428/913 |
| 4,577,205 | 3/1986 | Shibata et al. | 346/204 |

*Primary Examiner*—Bruce H. Hess
*Attorney, Agent, or Firm*—Oblon, Fisher, Spivak, McClelland, & Maier

[57] ABSTRACT

A thermosensitive recording adhesive sheet capable of forming colored images thereon upon application of heat, comprising (a) a support material with print patterns on the front side or back side thereof, (b) a thermosensitive coloring layer formed on the support material, (c) an adhesive layer formed on the back side of the support material, opposite to the thermosensitive coloring layer, and (d) a disposable backing sheet which is attached to the adhesive layer and can be peeled off the adhesive layer when the thermosensitive recording adhesive label is used. When necessary, (e) a protective layer for protecting the thermosensitive coloring layer and for improving the thermal head matching properties of the thermosensitive coloring layer can be formed on the thermosensitive coloring layer. Further, (f) an undercoat layer which is interposed between the support material and the thermosensitive coloring layer and (g) a back coat layer which bears a print pattern and is formed on the back side of the support material, opposite to the undercoat layer, can also be formed.

9 Claims, 4 Drawing Figures

THERMOSENSITIVE RECORDING ADHESIVE SHEET

BACKGROUND OF THE INVENTION

The present invention relates to a thermosensitive recording adhesive sheet capable of forming colored images thereon upon application of heat, which comprises: (a) a support material with print patterns on the front side or back side on the support material, (b) a thermosensitive coloring layer formed thereon, (c) an adhesive layer formed on the back side of the support material, opposite to the thermosensitive coloring layer, and (d) a disposable backing sheet which is attached to the adhesive layer and can be peeled off the adhesive layer when the thermosensitive recording adhesive label is used. When necessary, a protective layer can be formed on the thermosensitive coloring layer for protecting the thermosensitive coloring layer from intrusion of adverse materials which may discolor the thermosensitive coloring layer and for improving the thermal head matching properties of the thermosensitive coloring layer during thermal printing by use of a thermal head or pen. Further, an undercoat layer can be interposed between the support material and the thermosensitive coloring layer by coating the layer on the support material in such a manner that the undulations of the support material are completely covered to form a smooth base for the thermosensitive coloring layer. This undercoat layer also serves to block the penetration of the components of the thermosensitive coloring layer into the support material, thereby protecting the thermosensitive coloring layer. Furthermore, a back coat layer can be formed on the back side of the support material, opposite to the undercoat layer, in such a manner that a print pattern is printed on the back coat layer, instead of directly printing a print pattern on the back side of the support material. This back coat layer is for preventing intrusion of the ink of the print pattern into the thermosensitive coloring layer, when the thermosensitive recording adhesive sheet comes into contact with water or organic solvents.

A conventional thermosensitive recording material comprises a support material made of, for example, a sheet of ordinary paper or synthetic paper, or a resin film, and a thermosensitive coloring layer, formed on the support material, on which coloring layer colored images can be formed by application of heat thereto. For application of heat for such image formation, for example, a thermal printer provided with a thermal head, a thermal pen and infrared rays are in general use.

Because of the capability of forming colored images by simple application of heat, such thermosensitive recording materials are widely used, not only for copying books and documents, but also for recording output information from computers, facsimile apparatus, telex and other information transmission and measuring instruments. Furthermore, such thermosensitive recording materials are employed as railway tickets and as adhesive labels for the POS (point of sales) system in supermarkets and department stores.

A thermosensitive recording adhesive sheet is such a sheet that allows thermal printing of images, characters or design patterns thereon, which can be stuck to any solid articles, with elimination of a disposable backing sheet from an adhesive layer formed on the back side of the thermosensitive recording adhesive sheet. Therefore, it is used as a variety of labels such as number plate label, price mark label, reagent label, name plate label and seal.

Generally it is desired that various designs, lines and characters be printed on such thermosensitive recording adhesive sheet prior to thermal printing. Conventionally, when such preprinting is desired, the desired designs, patterns or characters are printed on the top layer, for instance, on the thermosensitive coloring layer or on the protective layer, using a printing ink. However, when a thermal head comes into contact with the preprinted designs, patterns or characters in the course of thermal printing by use of a thermal head or pen, the components coming from the printed patterns or characters adhere or stick to the thermal head. As a result, tailing of the thermally printed images occurs and the thermal head matching properties of the thermosensitive recording material are considerably impaired.

SUMMARY OF THE INVENTION

It is therefore an object of the present invention to provide a thermosensitive recording adhesive sheet having print patterns, which allows smooth thermal printing by a thermal head or pen, without the thermal head matching properties being affected at all by the presence of the print patterns which are preprinted on the thermosensitive recording adhesive sheet.

According to the present invention, the above object is achieved by a thermosensitive recording adhesive sheet comprising: (a) a support material with print patterns on the front side or back side thereof, (b) a thermosensitive coloring layer formed on the support material, (c) an adhesive layer formed on the back side of the support material, opposite to the thermosensitive coloring layer, and (d) a disposable backing sheet which is attached to the adhesive layer and can be peeled off the adhesive layer when the thermosensitive recording adhesive sheet is used.

When necessary, a protective layer can be formed on the thermosensitive coloring layer for protecting the thermosensitive coloring layer from intrusion of adverse materials which may discolor the thermosensitive coloring layer and for improving the thermal head matching properties of the thermosensitive recording adhesive sheet.

Further, an undercoat layer can be interposed between the support material and the thermosensitive coloring layer for achieving uniform coating of the thermosensitive coloring layer on the support material and for protecting the thermosensitive coloring layer.

Furthermore, a back coat layer with a print pattern printed thereon can be formed on the back side of the support material, opposite to the undercoat layer, instead of printing a print pattern directly on the back side of the support material. This back coat layer is for preventing intrusion of the ink of the print pattern into the support material and into the thermosensitive coloring layer, when the thermosensitive recording adhesive sheet comes into contact with water or organic solvents.

DETAILED DESCRIPTION OF THE PREFERRED EMBODIMENTS

By referring to FIGS. 1 and 2, which respectively show a schematic perspective view of an embodiment of a thermosensitive recording adhesive sheet according to the present invention and a schematic partial sectional view of the embodiment taken on line X—X' in FIG. 1, the present invention will now be explained.

Figure 2:
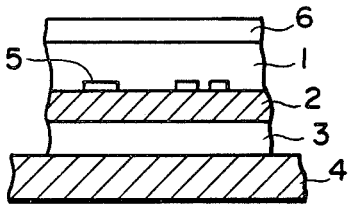
FIG. 2 is a schematic partial sectional view of the above embodiment taken on line X—X' in FIG. 1.

In FIG. 2, reference numeral 1 indicates a thermosensitive coloring layer; reference numeral 2, a support material which supports the thermosensitive coloring layer 1; reference numeral 3, an adhesive layer which is formed on the back side of the support material 2, opposite to the thermosensitive coloring layer 1; reference numeral 4, a disposable backing sheet which is attached to the adhesive layer 3 and can be peeled off the adhesive layer 3 when the thermosensitive recording adhesive sheet is used; reference numeral 5 indicates a print pattern which is preprinted on the front side (i.e., a thermosensitive coloring layer side) of the support material 2; and reference numeral 6, a protective layer which is formed on the thermosensitive coloring layer 1 to protect the thermosensitive coloring layer 1 from intrusion of adverse materials which may discolor the thermosensitive coloring layer 1 and to improve the thermal head matching properties of the thermosensitive coloring layer 1.

Figure 3:
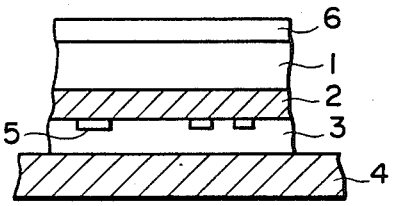
FIG. 3 is a schematic partial sectional view of another embodiment of a thermosensitive recording adhesive sheet according to the present invention.

FIG. 3 is a schematic partial cross sectional view of another embodiment of a thermosensitive recording adhesive sheet according to the present invention. In this figure, the same reference numerals as those employed in FIG. 1 respectively indicate the same components as those in the embodiment shown in FIG. 1. In this embodiment, the print pattern 5 is formed on the back side (i.e., an adhesive layer side) of the support material 2.

As mentioned above, in the present invention, the print pattern 5 is printed either on the front side or on the back side of the support material 2, prior to thermal printing. Alternatively, the print pattern 5 can be formed on a back coat layer formed on one side of the support material 2, without directly printing the print pattern 5 on the support material 2 as will be explained later. When the print pattern 5 is printed on the front side as shown in FIG. 2, the thermosensitive coloring layer formed on the print pattern is so thin and transparent that the print pattern 5 is sufficiently legible for use in practice through the thermosensitive coloring layer 1 as illustrated by the broken lines in FIG. 1.

When the print pattern 5 is printed on the back side of the support material 2 as shown in FIG. 3, a transparent support material is employed as the support material 2, so that the print pattern 5 can be seen through the support material 2. As such support material, any materials can be used as long as they are transparent to the extent that the print pattern 5 is legible. Such a print pattern can be printed at any appropriate step during the course of producing the thermosensitive recording adhesive sheet and any kinds of print patterns can be printed.

As the thermosensitive coloring layer 1 in the thermosensitive recording adhesive sheet according to the present invention, any conventional thermosensitive coloring systems can be employed. For example, the following can be employed:

(1) A thermosensitive coloring system comprising a combination of a long-chain fatty acid iron salt such as iron stearate and iron myristate, and a phenolic compound such as tannic acid, gallic acid and ammonium salicylate.

(2) A thermosensitive coloring system comprising a combination of a heavy metal sulfate such as silver sulfate, lead sulfate, mercury sulfate and thorium sulfate, and a sulfur compound such as sodium tetrathionate, sodium thiosulfate and thiourea.

(3) A thermosensitive coloring system comprising a combination of an organic acid noble metal salt such as silver behenate and silver stearate, and an aromatic organic reducing agent such as protocatechuic acid, spiro-indane and hydroquinone.

(4) A thermosensitive coloring system comprising a combination of an organic acid lead salt such as lead caproate, lead pelargonate and lead behenate, and a thiourea derivative such as ethylenethiourea and N-dodecylthiourea.

(5) A thermosensitive coloring system comprising a combination of a leuco dye and a color developer.

As such a leuco dye for use in the present invention, any leuco dyes that are employed in the conventional thermosensitive recording materials can be employed. For example, triphenylmethane-type leuco compounds, fluoran-type leuco compounds, phenothiazine-type leuco compounds, auramine-type leuco compounds and spiropyran-type leuco compounds can be employed.

As the color developer, a variety of electron acceptors can be employed, for instance, phenolic materials, organic and inorganic acids, salts and esters of the acids, which react with the above leuco dyes when heat is applied thereto to induce color formation in the leuco dyes.

The thermosensitive coloring layer 2 including one of these thermosensitive coloring systems is usually formed on the support material 2 with addition of a conventionally employed appropriate binder agent.

On the top surface of the thermosensitive coloring layer 2, the protective layer 6 can be formed, when necessary, which serves to protect the thermosensitive coloring layer 1 from intrusion of any adverse materials such as plasticizers which may decompose colored materials formed in the thermosensitive coloring layer 1 and to prevent components coming from the thermosensitive coloring layer from adhering or sticking to a thermal head or pen in the course of thermal printing, thereby improving the resistance to adverse chemicals and the thermal head matching properties of the thermosensitive recording adhesive sheet.

It is preferable that the protective layer 6 comprise as the main component a film-forming, heat-resistance resin, such as a water-soluble polymeric material.

Examples of water-soluble polymeric materials for use in the protective layer 6 are polyvinyl alcohol, carboxymethylcellulose, methylcellulose, hydroxypropylcellulose, polyacrylamide, starch, gelatin, casein and polyvinyl pyrrolidone.

The adhesive layer 3 can be formed, for example, by coating a polyacrylic resin type adhesive on the back side of the support material 2.

As the disposable backing sheet 4, any conventional backing sheets can be employed. For example, a disposable backing sheet made of high quality paper (with a basis weight of about 50 g/m$^2$) with a coating of non-sticking silicone resin can be employed.

Figure 4:
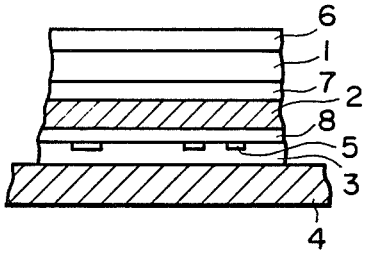
FIG. 4 is a schematic partial sectional view of a further embodiment of a thermosensitive recording adhesive sheet according to the present invention.

Referring to FIG. 4, a further embodiment of a thermosensitive recording adhesive sheet according to the present invention will now be explained.

Figure 1:
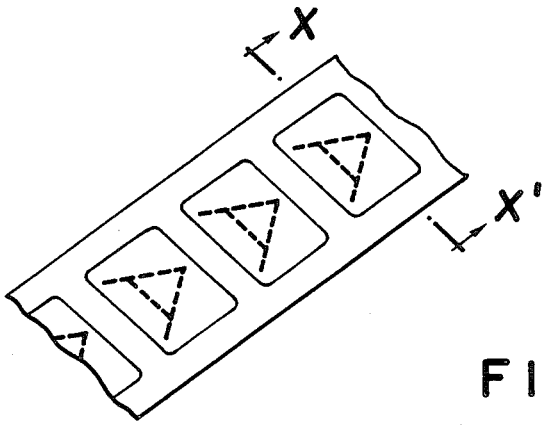
FIG. 1 is a schematic perspective view of an embodiment of a thermosensitive recording adhesive sheet according to the present invention.

In this figure, the same reference numerals as those employed in FIG. 1 respectively indicate the same components as those in the embodiment shown in FIG. 1.

In FIG. 4, reference numeral 7 indicates an undercoat layer which is interposed between the support material 2 and the photosensitive coloring layer 1, and reference numeral 8 indicates a back coat layer.

The undercoat layer 7 is coated in such a manner that the undulations of the surface of the support material 2 are completely covered to form a smooth base for forming the thermosensitive coloring layer 2 thereon. The undercoat layer 7 also serves to block the penetration of the components of the thermosensitive coloring layer 1 into the support material 2. For these purposes, the undercoat layer 7 can be composed of a mixture containing, for example, a filler and a binder resin as the main components. As such a filler and a binder agent, any conventional fillers and binder agents that are employed in the field of thermosensitive recording materials can be employed.

In this embodiment, by the presence of the undercoat layer 7, the thermosensitive coloring layer can be formed with a predetermined uniform thickness and without the original formulation of the components of the thermosensitive coloring layer 1 being changed during the coating process, since substantially no components of the thermosensitive coloring layer penetrate the support material 2. As a result, the thermosensitivity of the thermosensitive coloring layer 1 can be maintained high as originally intended.

The back coat layer 8 comprising as the main component, for example, a water-soluble polymeric material or a water-repellent polymeric material, and bearing the print pattern 5 thereon, can be formed on the back side of the support material 2, opposite to the undercoat layer 7. The back coat layer is for preventing intrusion of the ink of the print pattern 5 into the support material 2 and into the thermosensitive coloring layer 1, so that the coloring of the background of the thermosensitive coloring layer 1 is prevented even if the thermosensitive coloring adhesive sheet comes into contact with water or an organic solvent.

According to the present invention, because of the above described particular structures, there can be provided thermosensitive recording adhesive sheets, which allow smooth thermal printing by a thermal head or pen, without the thermal head matching properties thereof being affected at all by the presence of the print patterns.

What is claimed is:

1. In a thermosensitive recording adhesive sheet capable of forming colored images thereon upon application of heat, comprising:
   (a) a support material,
   (b) a thermosensitive coloring layer formed on said support material,
   (c) an adhesive layer formed on the back side of said support material, opposite to the thermosensitive coloring layer, the
   (d) a disposable backing sheet which is attached to said adhesive layer and can be peeled off said adhesive layer when said thermosensitive recording adhesive label is used, the improvement which comprises preprinted print patterns located solely on one side of said support material, and said preprinted print patterns are visible through said thermosensitive coloring layer.

2. A thermosensitive recording adhesive sheet as claimed in claim 1, further comprising a protective layer for protecting said thermosensitive coloring layer, which is formed on said thermosensitive coloring layer.

3. A thermosensitive recording adhesive sheet as claimed in claim 2, wherein said protective layer comprises as the main component a water-soluble polymeric material.

4. A thermosensitive recording adhesive sheet as claimed in claim 1, further comprising an undercoat layer which is interposed between said support material and said thermosensitive coloring layer.

5. A thermosensitive recording adhesive sheet as claimed in claim 4, wherein said undercoat layer comprises as the main components a filler and a binder agent.

6. Thermosensitive recording sheet of claim 1, further comprising a protective layer formed on said thermosensitive coloring layer.

7. In a thermosensitive recording adhesive sheet capable of forming colored images thereon upon application of heat, comprising:
   (a) a transparent support material,
   (b) a thermosensitive coloring layer formed on said support material,
   (c) a back coat layer formed on the back side of said support material, opposite to the thermosensitive coloring layer,
   (d) an adhesive layer formed on the remaining surface of said back coat layer opposite said support material,
   (e) a disposal backing sheet attached to said adhesive layer which can be peeled off said adhesive layer for use, the improvement comprising preprinted print patterns located solely on said back coat layer, and said preprinted print patterns are visible through said thermosensitive coloring layer.

8. A thermosensitive recording adhesive sheet as claimed in claim 7, wherein said back coat layer comprises as the main component a water-soluble polymeric material or a water-repellent polymeric material.

9. Thermosensitive recording sheet of claim 7, further comprising an undercoat interposed between said support material and said thermosensitive coloring layer.

* * * * *